US008578950B2

(12) United States Patent
Rosenbauer et al.

(10) Patent No.: US 8,578,950 B2
(45) Date of Patent: Nov. 12, 2013

(54) DISHWASHER WITH A DEVICE FOR DISSOLVING DETERGENT

(75) Inventors: Michael Rosenbauer, Reimlingen (DE); Bernd Schessl, Dillingen/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1955 days.

(21) Appl. No.: 11/794,519

(22) PCT Filed: Oct. 19, 2005

(86) PCT No.: PCT/EP2005/055364

§ 371 (c)(1),
(2), (4) Date: Jun. 28, 2007

(87) PCT Pub. No.: WO2006/072481

PCT Pub. Date: Jul. 13, 2006

(65) Prior Publication Data

US 2010/0012158 A1 Jan. 21, 2010

(30) Foreign Application Priority Data

Dec. 29, 2004 (DE) ..... 10 2004 063 284

(51) Int. Cl.
*A47L 15/44* (2006.01)

(52) U.S. Cl.
USPC ..... 134/93; 134/56 D; 134/57 D; 134/58 D; 134/99.2; 134/104.2

(58) Field of Classification Search
USPC ..... 134/56 D, 57 D, 58 D, 93, 99.2, 104.2
See application file for complete search history.

(56) References Cited

U.S. PATENT DOCUMENTS

| | | | | |
|---|---|---|---|---|
| 3,918,644 | A * | 11/1975 | Platt et al. | 239/243 |
| 5,261,432 | A * | 11/1993 | Sandrin | 134/93 |
| 5,593,648 | A * | 1/1997 | Christie et al. | 422/266 |
| 2002/0117511 | A1 * | 8/2002 | McNabb et al. | 221/197 |
| 2003/0106570 | A1 * | 6/2003 | Cerruti | 134/18 |

FOREIGN PATENT DOCUMENTS

| | | | |
|---|---|---|---|
| DE | 199 35 728 | | 2/2001 |
| DE | 199 60 496 | | 7/2001 |
| EP | 0 298 353 | | 1/1989 |
| EP | 0 677 697 | | 10/1995 |
| EP | 0 858 768 | | 8/1998 |
| EP | 1 281 346 | | 2/2003 |
| EP | 1 366 704 | | 12/2003 |
| JP | 06017663 | U | 3/1994 |
| WO | WO03/099096 | * | 12/2003 |

OTHER PUBLICATIONS

International Search Report PCT/EP2005/055364.

* cited by examiner

*Primary Examiner* — Michael Kornakov
*Assistant Examiner* — Benjamin L Osterhout
(74) *Attorney, Agent, or Firm* — James E. Howard; Andre Pallapies

(57) ABSTRACT

A dishwasher includes a device for adding detergent that can be sealed with a flap-type lid and which is set back in the inside door of the dishwasher and is arranged at an angle on an inclined plane in relation to the plane of the inner side of the door. During the cleaning process, the detergent falls into a dissolving chamber, which is arranged underneath the device for adding detergent, according to the program, wherein the bottom of the dissolving chamber consists of a fine-mesh grid whereat the detergent can be dissolved.

19 Claims, 4 Drawing Sheets

DISHWASHER WITH A DEVICE FOR DISSOLVING DETERGENT

Figure 1:
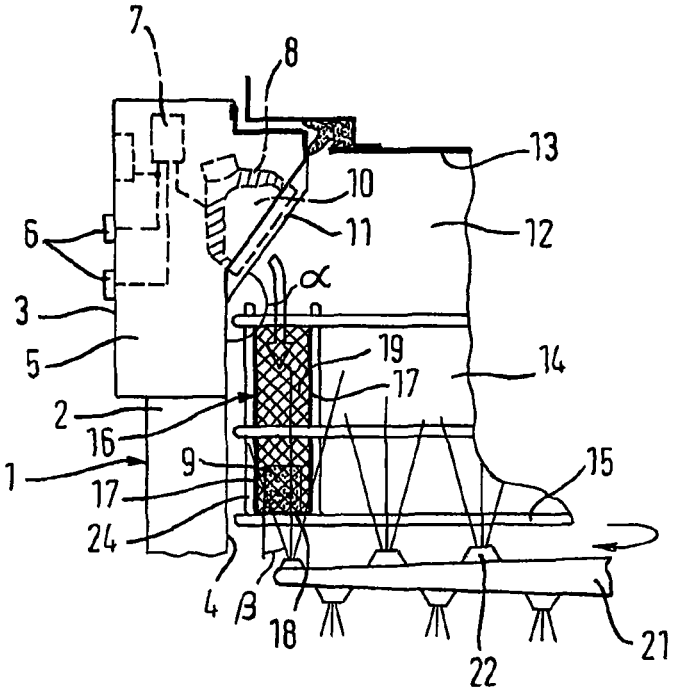

The present invention relates to a dishwasher with a door, in which a detergent dispenser is disposed for detergent, which is fed to a treatment compartment, in which at least one storage container is disposed for items to be cleaned, which are sprayed by at least one spray device.

A device to accommodate dishwasher detergents in the form of compressed powder tablets in domestic dishwashers is known from DE 3722648, which allows the compressed powder tablets to be accommodated inside the dishwasher without having an adverse effect on the wash result. This is achieved by configuring the device as a dosing container that can be affixed inside the dishwasher with at least one dosing chamber accommodating the tablet, having sides and/or base surfaces that are perforated at least in parts.

It is a disadvantage however that the detergent is present in the dishwasher before the first wash cycle. The wash program can therefore not control the correct time for dispensing the detergent. The dissolving response of the detergent is therefore influenced in a negative manner, resulting in a poor wash result.

It is also known from the prior art that detergent tablets can be placed in a basket before the cleaning process and then dissolve during the entire cleaning process.

One serious disadvantage results from the detergent tablets not dissolving sufficiently during the cleaning process, leaving unwanted clumps in the treatment compartment after the cleaning process. It cannot be excluded that the detergent tablets might come into contact with the dishes, with the result that unwanted spots may form on the dishes.

The object of the invention is to feed the detergent to the treatment compartment during operation in the case of dishwashers of the type referred to in the introduction in such a manner that no detergent residues remain in the treatment compartment after the cleaning process.

This object is achieved in that the detergent is fed to at least one dissolving chamber disposed on the storage container during operation.

This arrangement allows the detergent to be fed specifically to a dissolving chamber at the correct time for the cleaning process, with the detergent being able to dissolve properly in said dissolving chamber. This prevents detergent residues remaining in the dishwasher after the cleaning process. This arrangement also prevents the detergent coming into contact with the dishes, thereby preventing the formation of spots on the dishes.

According to one preferred embodiment provision is made for the dissolving chamber to be disposed on a front side wall of the storage container.

The significant advantage of this is that the dissolving chamber is disposed so that it is easily accessible for the user, for example for cleaning it, when food residues have built up.

According to an alternative refinement of the subject matter of the invention provision can be made for the dissolving chamber to be disposed on a front wall of the storage container. This arrangement ensures that the transport path between the dispenser and the dissolving chamber is short and the detergent drops reliably into the cleaning chamber. The structural outlay is also very low, as no additional tools are required.

In a further alternative refinement of the subject matter of the invention provision can be made for the dissolving chamber to be disposed in the center of the storage container. The solution has the advantage that the dissolving chamber can be subjected efficiently to fluid by the spray device, as a result of which the detergent can be essentially dissolved. Also the dissolving chamber is easily accessible for the user.

According to a further preferred embodiment provision is made for the dissolving chamber to be configured as an integral part of the storage container.

A storage container constructed according to these features is characterized in that the manufacturing outlay is low, since the storage compartment and dissolving chamber can be formed as a single part.

According to an alternative refinement of the subject matter of the invention provision is made for the dissolving chamber to be configured as an independent component assigned to the storage container.

The significant advantage of this is that the user is able to remove the dissolving chamber from the storage container disposed in the treatment compartment for cleaning purposes. Also the dissolving compartment can be replaced in the event of damage, without having to change the storage container.

According to a further preferred embodiment provision is made for at least one chamber wall and a base of the dissolving chamber to be configured to allow the passage of fluids.

This measure makes it possible for cleaning fluid to enter the dissolving chamber to dissolve the detergent. It also prevents the cleaning fluid collecting in the container, filling it and as a result causing the detergent to be flushed out of the dissolving chamber.

According to one preferred embodiment provision is made for the chamber wall and the base to be configured from a fine-mesh grid.

This advantageously prevents quite large clumps of the detergent dropping into the treatment compartment at an early stage. This ensures that the detergent can dissolve essentially in the dissolving chamber.

According to an alternative embodiment provision is made for the base of the dissolving chamber to have an opening, which is configured in a longitudinal and/or transverse manner in relation to the discharging jet of fluid.

The advantage of this is that the detergent is dissolved essentially during operation. The detergent is partially dissolved through the openings, with the result that the active agents of the detergent can dissolve better during the later course of the wash.

According to a further advantageous refinement of the subject matter of the invention provision is made for the base of the dissolving chamber to be configured in an arched manner.

As a result the detergent, in particular powder detergent, is advantageously positioned on the side walls, as a result of which the powder detergent cannot dissolve so quickly and is therefore carried away in the later phases of the cleaning process. This ensures that the items to be washed can also be cleaned at a later time.

According to an advantageous development of the subject matter of the invention provision is made for the spray device to be disposed above and/or below the dissolving chamber and to supply water to the dissolving chamber.

This arrangement of the spray device ensures that the dissolving chamber is always supplied with sufficient water, so that the detergent can dissolve effectively, in other words the formation of clumps of detergent is prevented.

According to a next preferred embodiment provision is made for at least one jet of fluid from the spray device to be deflected onto the base of the dissolving chamber.

This solution is characterized in particular in that the detergent disposed on the base of the dissolving chamber disintegrates efficiently during the cleaning process, so that clumps do not form in the corners of the dissolving chamber.

According to a further refinement of the subject matter of the invention provision can be made for the jet of fluid to strike the base at a right angle.

This ensures that the jet of fluid sprays the detergent with fluid and at the same time is not deflected from the base of the dissolving chamber to the side walls of the treatment compartment, since this might result in the occurrence of unwanted noise for the user.

In a further advantageous refinement of the subject matter of the invention provision is made for a filling flap of the detergent dispenser to be in a plane, which is at an angle α in relation to the plane of the inner side of the door.

The inventive dishwasher therefore has the advantage that during the opening process of the detergent dispenser the detergent automatically drops into the dissolving chamber assigned to the treatment compartment due to gravity.

According to an advantageous development of the subject matter of the invention provision is made for the detergent dispenser to be disposed above the storage container.

This ensures that the detergent drops into the dissolving chamber without further structural measures.

According to a preferred embodiment provision is made for the spray device to be configured as a spray base and for at least one spray pipe to be disposed below the dissolving chamber. This arrangement allows the detergent within the dissolving chamber to be supplied with water, in order to dissolve the detergent therewith, regardless of the position of the dissolving chamber.

Construction is particularly simple and economical when the spray device is configured as a spray nozzle or sprinkler.

According to an alternative refinement of the subject matter of the invention provision is made for the spray device to have at least one rotating spray arm with at least one spray nozzle.

The solution has the advantage that the dissolving chamber and the detergent disposed in the dissolving chamber are supplied with sufficient fluid.

According to a preferred refinement of the subject matter of the invention provision is made for the distance between the spray device and the base of the dissolving chamber to be sufficient to dissolve the detergent in an essentially complete manner.

The advantage is that there are no residues of detergent left in the dissolving chamber after operation, so the user can be certain that the detergent was able to deploy all its active agents during the cleaning process. It also prevents the user having to clean the dissolving chamber, thereby dispensing with a further work step.

Figure 2:
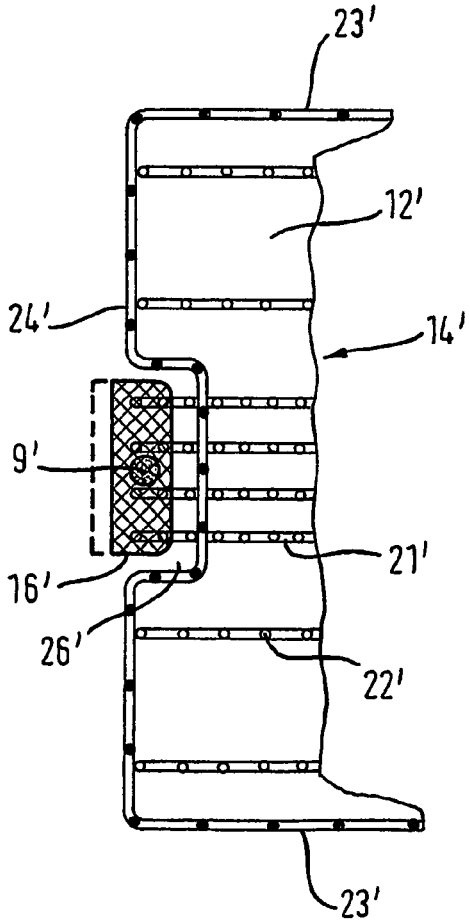
Figure 3:
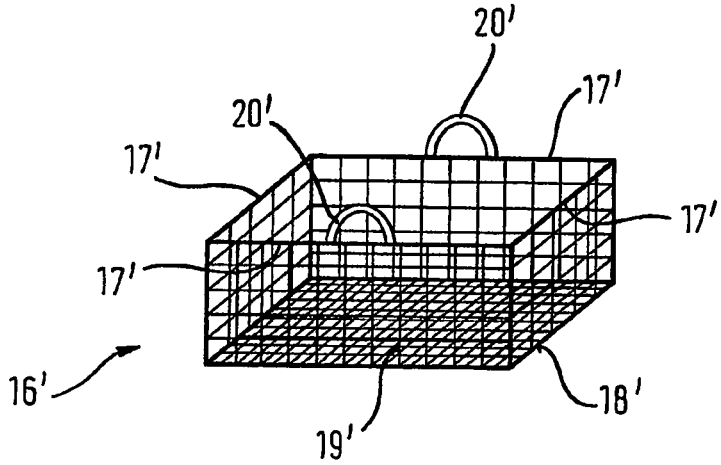
Figure 4:
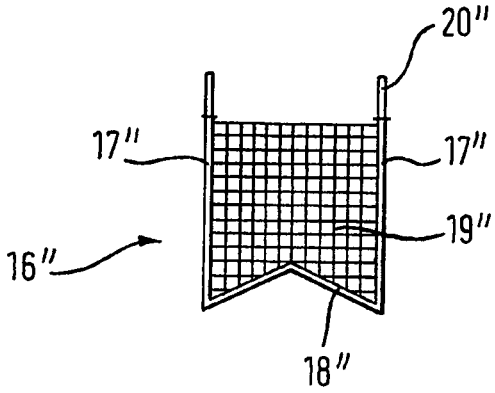

The invention is described in the description which follows with reference to an exemplary embodiment shown in a simplified manner in the drawing, in which:

FIG. 1 shows a segment shown from the side and in a partial section of a dishwasher with a detergent dispenser disposed on the inner side of its door FIG. 2 shows a segment of the basket of the dishwasher viewed from above, with a dissolving chamber disposed on its front side FIG. 3 shows a perspective view of the dissolving chamber from above and FIG. 4 shows the dissolving chamber with an arched base viewed from the front.

FIG. 1 shows a first embodiment of an inventive dishwasher 1 with a door 2, having an outer door 3 and an inner door 4. Program selection buttons 6 are disposed on a door panel 5, said program selection buttons 6 being connected to an electrical electronic control and regulation unit 7 installed inside the door 2. Various programs for running a cleaning process are stored in the memory of the electronic control and regulation unit 7. Inside the door 2 is a detergent dispenser 8 to hold a block-type detergent 9 and a rinse aid, said detergent dispenser 8 being connected to the electronic control and regulation unit 7. The detergent dispenser 8 is however also suitable for holding liquid or powder detergent. A chamber 10, to which a filling flap 11 is assigned for sealing purposes, serves to store the detergent 9 and is disposed set back in the inner door 4. The filling flap 11 is in a plane at an angle α in relation to the plane of the inner side of the door.

A treatment compartment 12 accessible by way of the opened door 2 and with an inner shell 13 made of stainless steel has two guide rails (not shown) on its container side walls (also not shown), on which guide rails a basket configured as a storage container 14 is held for holding items to be cleaned (not shown). The body of the storage container 14 has plastic-coated metal bars 15. A dissolving chamber 16, which is integrated in the body of the storage container 14, has chamber walls 17 and a base 18, all having a fine-mesh grid 19. The dissolving chamber 16 is located below the filling flap 11 of the detergent dispenser 8. A spray arm configured as a spray device 21 has a number of spray nozzles 22 on its upper side and on its lower side. In the case of spray devices 21, in particular in the case of a rotating spray arm, the dissolving chamber 16 is advantageously located on a front wall 24 in the center of the storage container 14.

FIG. 2 shows a storage container 14' with a dissolving chamber 16'. A spray device 21' configured as a spray base with spray nozzles 22' is integrated into the body of the storage container 14'. Alternatively the spray base can also be located below the storage container 14'.

Side walls 23' and a front wall 24' are assigned to the storage container. The dissolving chamber 16' is held in a detachable manner on the front wall 24' in the center of the storage container 14', where the storage container 14' has a recess 26' for insertion of the dissolving chamber 16'. Alternatively however the dissolving chamber 16' can also be disposed on the side walls 23' of the dissolving chamber 16'. The dissolving chamber 16' is preferably located below a detergent dispenser (not shown).

FIG. 3 shows the dissolving chamber 16'. It has four chamber walls 17' and a base 18'. The chamber walls 17' and base 18' of the dissolving chamber 16' are configured as a fine-mesh grid 19'. Alternatively the chamber walls 17' can optionally also be configured as a coarse-mesh grid. Alternatively the base 18' is configured from one or more openings, which are configured in a longitudinal or transverse manner in relation to the direction of the discharging jet of fluid. Handles 20' are disposed on the chamber walls 17'.

FIG. 4 shows the dissolving chamber 16". It has four chamber walls 17" and a base 18", all of which are configured from a fine-mesh grid 19". Alternatively one or more small openings can be disposed instead of the fine-mesh grid 19". Similarly a coarse-mesh grid can alternatively be used, to dissolve the detergent more quickly. The base of the dissolving chamber is arched in a longitudinal manner in relation to the handles 20", so that the detergent, in particular powder detergent, slips down to the boundary between the chamber walls 17" and the arched base 18". It accumulates there, forming small piles, and cannot therefore be flushed out of the dissolving chamber 16" immediately. This allows the detergent to be distributed more evenly during the cleaning process. Alternatively the arching of the base 18" can also be configured in a transverse manner in relation to the handles 20".

The detergent 9, in particular a detergent tablet, is placed in the detergent dispenser 8 by the user and sealed in by way of the flap-type lid 11. The user seals the treatment compartment 12 using the door 2 and uses the program selection switch 6 to select a program, which essentially comprises the program steps "pre-rinse—wash—intermediate rinse—final rinse (with rinse aid)—dry" and is stored in the electronic control and regulation unit 7.

During the cleaning process the electronic control and regulation unit 7 selects the time for opening the flap-type lid 11 of the detergent dispenser 8 as a function of the program. Since the flap-type lid 11 is disposed in a plane, which is at an angle α (FIG. 1) to the plane of the inner side of the door 2, the detergent 8 drops out of the chamber 12 due to gravity. The detergent 8 drops into the dissolving chamber 16 assigned to the storage container 14. Since the chamber walls 17 and the base 18 of the dissolving chamber 16 have a fine-mesh grid 19, no larger detergent elements drop out of the dissolving chamber 16, so the detergent 9 is held securely. The fine-mesh grid 19 is also configured to allow the passage of water, so the fluid can penetrate into the dissolving chamber 16 and dissolve the detergent 8. It is not possible for larger clumps of detergent 8 to drop into the treatment compartment 14 and onto the items to be washed.

The spray arm configured as a spray device 21 wets the dissolving chamber 16 twice with every rotation. Jets of fluid are discharged from the spray nozzles 22 disposed on the upper side of the spray arm, striking the base 18 of the dissolving chamber 16 at an angle β in the region of 90°, so that the jets of fluid are not deflected from the dissolving chamber 16 onto the side walls of the container of the dishwasher 1.

If a detergent 9' in FIG. 2 has not dissolved completely in the dissolving chamber 16', it is possible to remove the independent dissolving chamber 16' from the treatment compartment 12' after operation with the aid of the handles 20' and clean it, so that the detergent 9' does not go moldy during longish breaks between operations, causing unpleasant odors in the treatment compartment 12'.

The invention claimed is:

1. A dishwasher comprising:

a door;

a detergent dispenser located on the door for dispensing detergent;

a treatment compartment in which items to be washed are disposed;

a storage container disposed in the treatment compartment for retaining items at a predetermined storage location within the treatment compartment;

a spray device operable to spray at least one jet of liquid; and, at least one dissolving chamber being mounted on the storage container with the storage container being wetted with liquid that has been sprayed by the spray device and the at least one dissolving chamber receiving detergent fed thereto by the detergent dispenser during operation of the dishwasher.

2. The dishwasher as claimed in claim 1, wherein the dissolving chamber is disposed on a front wall of the storage container.

3. The dishwasher as claimed in claim 1, wherein the dissolving chamber is disposed in the center of the storage container.

4. The dishwasher as claimed in claim 1, wherein the dissolving chamber is configured as an integral part of the storage container.

5. The dishwasher as claimed in claim 1, wherein the dissolving chamber is configured as an independent component associated with the storage container.

6. The dishwasher as claimed in claim 1, wherein at least one chamber wall and a base of the dissolving chamber are configured to allow the passage of fluids.

7. The dishwasher as claimed in claim 6, wherein the chamber wall and the base are configured from a fine-mesh grid base.

8. The dishwasher as claimed in claim 6, wherein a base of the dissolving chamber has an opening configured in one of a longitudinal and a transverse manner in relation to the discharging jet of liquid.

9. The dishwasher as claimed in claim 1, wherein a base of the dissolving chamber is configured in an arched manner.

10. The dishwasher as claimed in claim 1, wherein the spray device is disposed at a selected one of above and below the dissolving chamber and supplies water to the dissolving chamber.

11. The dishwasher as claimed in claim 1, wherein at least one jet of fluid leaving the spray device is deflected onto a base of the dissolving chamber.

12. The dishwasher as claimed in claim 11, wherein the jet of fluid strikes the base at a right angle.

13. The dishwasher as claimed in claim 1, wherein a filling flap of the detergent dispenser is in a plane which is at an angle a in relation to a plane of an inner side of the door.

14. The dishwasher as claimed in claim 1, wherein the detergent dispenser is disposed above the storage container.

15. The dishwasher as claimed in claim 1, wherein the spray includes a spray base and at least one spray pipe and the at least one spray pipe is disposed below the dissolving chamber.

16. The dishwasher as as claimed in claim 1, wherein the spray device is one of a spray nozzle and a sprinkler.

17. The dishwasher as claimed in claim 1, wherein the spray device has at least one rotating spray arm with at least one spray nozzle.

18. The dishwasher as claimed in claim 1, wherein the distance between the spray device and a base of the dissolving chamber is sufficient to dissolve the detergent in a substantially complete manner.

19. The dishwasher as claimed in claim 1, wherein the dissolving chamber is disposed on a front side wall of the storage container.

* * * * *

UNITED STATES PATENT AND TRADEMARK OFFICE

CERTIFICATE OF CORRECTION

PATENT NO. : 8,578,950 B2
APPLICATION NO. : 11/794519
DATED : November 12, 2013
INVENTOR(S) : Rosenbauer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1902 days.

Signed and Sealed this
Twenty-second Day of September, 2015

Michelle K. Lee

Michelle K. Lee
*Director of the United States Patent and Trademark Office*